US007848687B2

(12) United States Patent
Iwasaki

(10) Patent No.: US 7,848,687 B2
(45) Date of Patent: Dec. 7, 2010

(54) IMAGE FORMING DEVICE AND DEVIATION CORRECTING METHOD

(75) Inventor: Hiroyuki Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 586 days.

(21) Appl. No.: 11/896,354

(22) Filed: Aug. 31, 2007

(65) Prior Publication Data

US 2008/0056741 A1 Mar. 6, 2008

(30) Foreign Application Priority Data

Sep. 6, 2006 (JP) ..... 2006-241769
Jul. 12, 2007 (JP) ..... 2007-183402

(51) Int. Cl.
*G03G 15/01* (2006.01)

(52) U.S. Cl. ..... 399/301

(58) Field of Classification Search ..... 399/39, 399/66, 301, 49, 167, 299; 347/116
See application file for complete search history.

(56) References Cited

U.S. PATENT DOCUMENTS 4,752,804 A * 6/1988 Ohno ..... 399/300
5,493,384 A * 2/1996 Matsuno et al. ..... 399/225
5,587,771 A 12/1996 Mori et al.
5,881,346 A 3/1999 Mori et al.
7,054,586 B2 5/2006 Kuroda
7,245,862 B2 * 7/2007 Ebara ..... 399/299
2004/0197111 A1 10/2004 Kuroda
2005/0235652 A1 10/2005 Iwasaki
2005/0271429 A1 * 12/2005 Tachibana et al. ..... 399/301
2006/0002745 A1 1/2006 Iwasaki
2006/0039722 A1 * 2/2006 Ehara ..... 399/301
2006/0125430 A1 6/2006 Kato
2006/0133862 A1 6/2006 Kuroda
2007/0014595 A1 * 1/2007 Kawagoe ..... 399/301
2007/0059041 A1 3/2007 Iwasaki

FOREIGN PATENT DOCUMENTS

EP 0 816 930 A 1/1998
JP 2006-047990 2/2006

OTHER PUBLICATIONS

European Search Report (dated Dec. 17, 2007) for counterpart European Patent Application 07115532.9-1240 is provided for the purposes of certification under 37 C.F.R. §§ 1.97(e) and 1.704(d).

* cited by examiner

*Primary Examiner*—Robert Beatty
(74) *Attorney, Agent, or Firm*—Harness, Dickey & Pierce, P.L.C.

(57) ABSTRACT

In an image forming device, a main controller unit controls the image forming device, a motor controller unit controls individually rotational speeds of a plurality of motors rotating image carriers respectively, and a deviation detection unit detects a deviation of the color image. In the main controller unit, a speed signal transmitting unit transmits a speed signal, indicating a target rotational speed for correcting the deviation, to the motor controller unit. An enabling-signal transmitting unit transmits, to the motor controller unit, a speed-change enabling signal after passing of a predetermined time from a time an imaging reference signal, which is indicative of a start and an end of an image region of each color, indicates an end of a corresponding image region immediately after transmission of the speed signal.

16 Claims, 18 Drawing Sheets

IMAGE FORMING DEVICE AND DEVIATION CORRECTING METHOD

BACKGROUND OF THE INVENTION

1. Field of the Invention

This invention relates to an image forming device and its deviation correcting method, and more particularly to a tandem type color image forming device (such as color PPC, MFP, fax or printer) which controls individually the rotational speeds of motors (such as brushless motors) which rotate a plurality of image carriers, to correct a deviation (color deviation), and its deviation correcting method.

2. Description of the Related Art

Among electrophotographic image forming devices, the number of color image forming devices, such as color copiers and color printers, are increasing. Especially, the number of tandem-type color image forming devices are increasing. In such image forming device, a plurality of photoconductors are arranged along with a plurality of developing devices respectively, a monochrome toner image is formed on each photoconductor, respectively, and those monochrome toner images are transferred one by one to a sheet recording medium so that a color image is recorded on the sheet recording medium.

FIG. 9A, FIG. 9B and FIG. 9C are diagrams showing the composition of imaging units of some image forming devices according to the related art.

The image forming device of FIG. 9A is a tandem type electrophotographic color image forming device in which a plurality of photoconductors 11Y, 11C, 11M, and 11B (collectively called photoconductor 11) are arranged along with a plurality of developing devices 12Y, 12C, 12M, and 12B (collectively called developing device 12) and a plurality of transferring devices 13Y, 13C, 13M, and 13B (collectively called transferring device 13), respectively.

In the image forming device of FIG. 9A, a monochromatic toner image is formed on the surface of each photoconductor 11, respectively, and those monochrome toner images sequentially come in contact with an intermediate transfer belt 15 to form a combined color image on the intermediate transfer belt 15. The combined color image is transferred to a sheet recording medium so that a full color image can be formed.

In the image forming device of FIG. 9A, the plurality of drum-shaped photoconductors 11Y, 11C, 11M, and 11B are installed side by side. Each photoconductor is an independently rotatable image carrier, and an image of a different color is formed on the surface of each photoconductor, respectively.

Each image formed on each photoconductor 11 is transferred to the intermediate transfer belt 15 at a transfer position corresponding to each photoconductor 11, respectively. At the respective transfer positions on the intermediate transfer belt 15, the transferring devices 13Y, 13C, 13M, and 13B are moved up and down and those images on the respective photoconductors 11 are transferred.

By operating the contact/separation mechanisms 14YMC and 14B, the transferring devices 13 are moved up or down, so that they are brought in contact with or separated from the intermediate transfer belt 15. Around the periphery of each photoconductor 11, the developing device 12, the charging device 16, the cleaning device 17, and the discharging device 18 are arranged. Each photoconductor 11 is scanned by a laser beam from the laser writing unit 19 in accordance with the image signal of each color and an electrostatic latent image is formed on the photoconductor 11.

FIG. 9B shows the composition of the imaging unit of a direct-transfer type image forming device. In the direct transfer type, an image on a photoconductor is directly transferred to a recording medium.

In FIG. 9B, the elements which are the same as corresponding elements in FIG. 9A are designated by the same reference numerals and a description thereof will be omitted. In the image forming device of FIG. 9B, there are provided the photoconductors 11Y, 11C, 11M and 11B. Each photoconductor is an independently rotatable image carrier, and an image of a different color is formed thereon, respectively.

The images formed on the respective photoconductors 11 are directly transferred to a recording paper P by the transferring devices 13 at their corresponding transfer positions, respectively. The transferring devices 13Y, 13C, 13M, and 13B are moved up and down to the transfer conveying belt 30 at the transfer positions. By operating the contact/separation mechanisms 14YMC and 14B, the transferring devices 13 are brought in contact with or separated from the transfer conveying belt 30.

The transfer conveying belt 30 is stretched and wound between the driving roller 32 rotated by the transport motor 31 and the follower roller 33, and the direction of the rotation of the transfer conveying belt 30 is indicated by the arrow in FIG. 9B.

FIG. 9C shows the composition of the imaging unit of a tandem type image forming device having first and second intermediate transfer mediums. In this image forming device, there are provided the photoconductors 11Y, 11C, 11M, and 11B. Each photoconductor is an independently rotatable image carrier, and images of yellow, cyan, magenta, and black are formed on the photoconductors 11, respectively. The images formed on the two photoconductors 11Y and 11C among the four photoconductors are transferred to the intermediate transfer medium 34A at the primary transfer position P5 and P6.

The images formed on the remaining two photoconductors 11M and 11B are transferred to the intermediate transfer medium 34B at the primary transfer positions P7 and P8.

The intermediate transfer mediums 34A and 34B are rotatable independently. The intermediate transfer mediums 34A and 34B are rotated by the first medium transfer motors 35A and 35B. There are provided the transferring devices 13Y, 13C, 13M, and 13B and the contact/separation mechanisms 14Y, 14C, 14M, and 14B (collectively called contact/separation mechanism 14).

A monochromatic toner image is formed on each photoconductor 11, respectively. The contact/separation mechanism 14 is operated to bring the transferring device 13 in contact with the first intermediate transfer belt. The monochrome toner images are transferred one by one to the first intermediate transfer belt.

This image forming device includes an intermediate transfer drum 36 to which the images from the intermediate transfer mediums 34A and 34B are transferred respectively at the secondary transfer positions P9 and P10. The intermediate transfer drum 36 is rotated by the second medium transfer motor 37.

The image transferred by intermediate transfer drum 36 is transferred to the recording paper P with transfer roller 38 at the third transfer position P11. There is provided the transport belt 39 which is rotated in the direction to convey the recording paper P, and the transport belt 39 is stretched and wound between the driving roller 40 and the follower roller 41. When the driving roller 40 is rotated by the motor 42, the transport belt 39 is rotated in the direction indicated by the arrow in FIG. 9C.

In a color image forming device, the position where color images are combined may be shifted from the right position, and a color deviation or the like may occur on the combined image. Among the causes, there are the deviation of the laser beam irradiation angle when forming a latent image, the roughness of the timing resolution of an optical writing unit, the deviation of the mounting positions of photoconductor units, etc.

When the toner images of respective colors are transferred, a deviation (color deviation) may occur under those influences. If the transfer position is shifted from the desired transfer position, color irregularity or color deviation may occur on the combined image as a result of transferring and combining the images of colors.

In order to solve the above problem, it is necessary to reduce deviation (color deviation) by arranging a deviation correction unit that changes the rotational speed of each photoconductor and adjusts finely the time from exposure to transfer.

For example, Japanese Laid-Open Patent Application No. 2006-047990 discloses an image forming device which corrects deviation (color deviation) by changing the rotational speed of the motor which rotates each photoconductor, and changing the image resist position in the transfer unit.

The image forming device of Japanese Laid-Open Patent Application No. 2006-047990 uses a deviation correcting method. In this method, the rotational speed of each image carrier is adjusted so that the time for the image formed in the exposure position on each image carrier arrive at the transfer position is set to the same value between the image carriers when transferring the respective images formed on the plurality of image carriers to the transferring medium to form a combined color image.

In the image forming device of Japanese Laid-Open Patent Application No. 2006-047990, in advance of image formation, a pattern for detection of color deviation is formed on the transferring medium, and the amount of color deviation is determined based on the result of detection of the pattern for color deviation detection using the sensor.

However, to change actually the rotational speed of the motor rotating the image carrier in order to correct the detected color deviation, a control mode for color deviation correction must be set up in the image forming device. During this control mode, operation of the motor must be suspended so that the rotational speed of the motor can be changed.

For this reason, in order to form a color image after the correction of color deviation, an excessively long time which includes the time to perform the control mode for color deviation correction, and the time to restart the motor and reach a target rotational speed, in addition to the time for image formation, was required according to the related art.

SUMMARY OF THE INVENTION

According to one aspect of the invention, there is provided an improved image forming device in which the above-described problems are eliminated.

According to one aspect of the invention there is provided an image forming device which is capable of correcting a deviation (color deviation) while continuously operating the motors to rotate the photoconductors, so that the time needed for deviation correction is shortened and the efficiency of image formation is raised.

In an embodiment of the invention which solves or reduces one or more of the above-mentioned problems, there is provided an image forming device in which a plurality of image carriers are installed in a tandem manner, images of different colors are formed on the image carriers and combined to form a color image, the image forming device including a main controller unit controlling the image forming device, a motor controller unit controlling individually rotational speeds of a plurality of motors rotating the image carriers respectively, and a deviation detection unit detecting a deviation of the color image, the main controller unit comprising: a speed signal transmitting unit transmitting a speed signal, indicating a target rotational speed for correcting the deviation detected by the deviation detection unit, to the motor controller unit; and an enabling-signal transmitting unit transmitting, to the motor controller unit, a speed-change enabling signal that enables the motor controller unit to start a speed change of a rotational speed of one of the motors, after passing of a predetermined time from a time an imaging reference signal, which is indicative of a start and an end of an image region of each color, indicates an end of a corresponding image region immediately after transmission of the speed signal.

The above-mentioned image forming device may be configured so that the motor controller unit is provided to include a speed data storing unit which stores speed data indicated by the speed signal into a memory, in response to the speed signal received from the main controller unit.

The above-mentioned image forming device may be configured so that the motor controller unit is provided to include a rotational speed change unit which reads the speed data from the memory in response to the speed-change enabling signal received from the main controller unit, and changes a rotational speed of the motor concerned to the target rotational speed.

The above-mentioned image forming device may be configured so that the motor controller unit is provided to include a stable-rotation-signal transmitting unit which transmits a stable-rotation signal to the main controller unit after the rotational speed of the motor concerned changed by the rotational speed change unit is stabilized.

The above-mentioned image forming device may be configured so that the deviation detection unit is provided to determine an amount of deviation from a target position based on detection results from a sensor which detects optically a pattern for deviation detection transferred to a transferring medium through the image carriers.

The above-mentioned image forming device may be configured so that the speed signal is a clock signal having a clock frequency indicating the target rotational speed.

The above-mentioned image forming device may be configured so that the speed signal is a clock signal having a clock frequency indicating the target rotational speed, and the speed signal transmitting unit is provided to transmit the clock signal to the motor controller unit when a deviation is detected by the deviation detection unit.

The above-mentioned image forming device may be configured so that the speed signal is a speed data which is transmitted to the motor controller unit through serial communication.

In an embodiment of the invention which solves or reduces one or more of the above-mentioned problems, there is provided a deviation correcting method for use in an image forming device in which a plurality of image carriers are installed in a tandem manner, images of different colors are formed on the image carriers and combined to form a color image, the image forming device including a main controller unit and a motor controller unit, the main controller unit controlling the image forming device, and the motor controller unit controlling individually rotational speeds of a plurality of motors rotating the image carriers respectively, the deviation correcting method comprising steps of: detecting a deviation of the color image; transmitting a speed signal, indicating a target rotational speed for correcting the deviation detected in the detecting step, from the main controller unit to the motor controller unit; and transmitting a speed-change enabling signal that enables the motor controller unit to start a speed change of a rotational speed of one of the motors, from the main controller unit to the motor controller unit after passing of a predetermined time from a time an imaging reference signal, which is indicative of a start and an end of an image region of each color, indicates an end of a corresponding image region immediately after transmission of the speed signal.

According to embodiments of the image forming device and the deviation correcting method of the invention, it is possible to correct a deviation (color deviation) while continuously operating the motors to rotate the photoconductors, so that the time needed for deviation correction is shortened and the efficiency of image formation is raised.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

Figure 1:
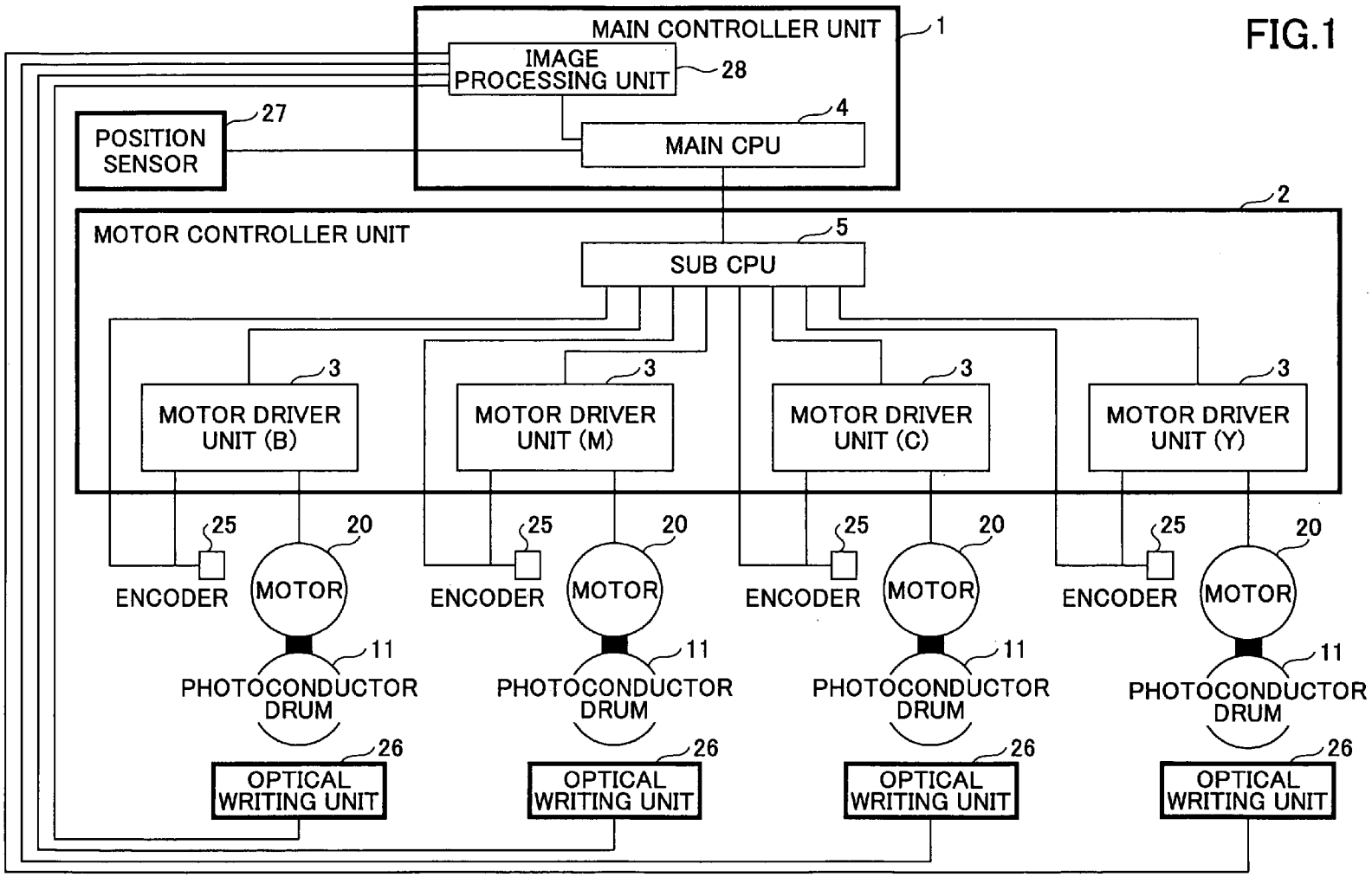
FIG. 1 is a block diagram showing the composition of a main controller unit and a motor controller unit of an image forming device in an embodiment of the invention.

FIG. 1 shows the composition of a main controller unit and a motor controller unit of an image forming device in an embodiment of the invention.

Figure 9A:
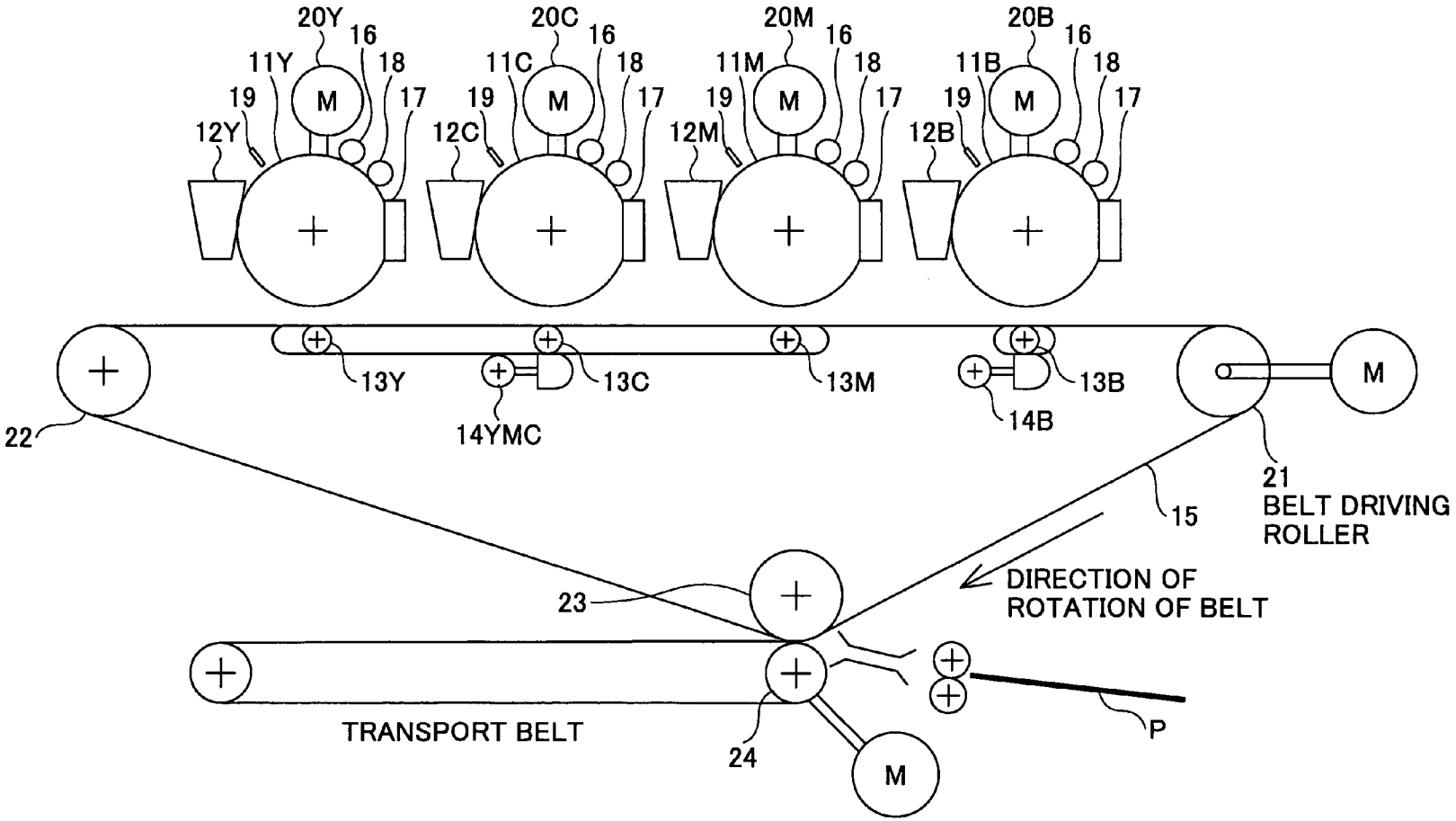
FIG.9A PRIOR ART
FIG. 9A is a diagram showing the composition of an imaging unit of an image forming device according to the related art.
Figure 9B:
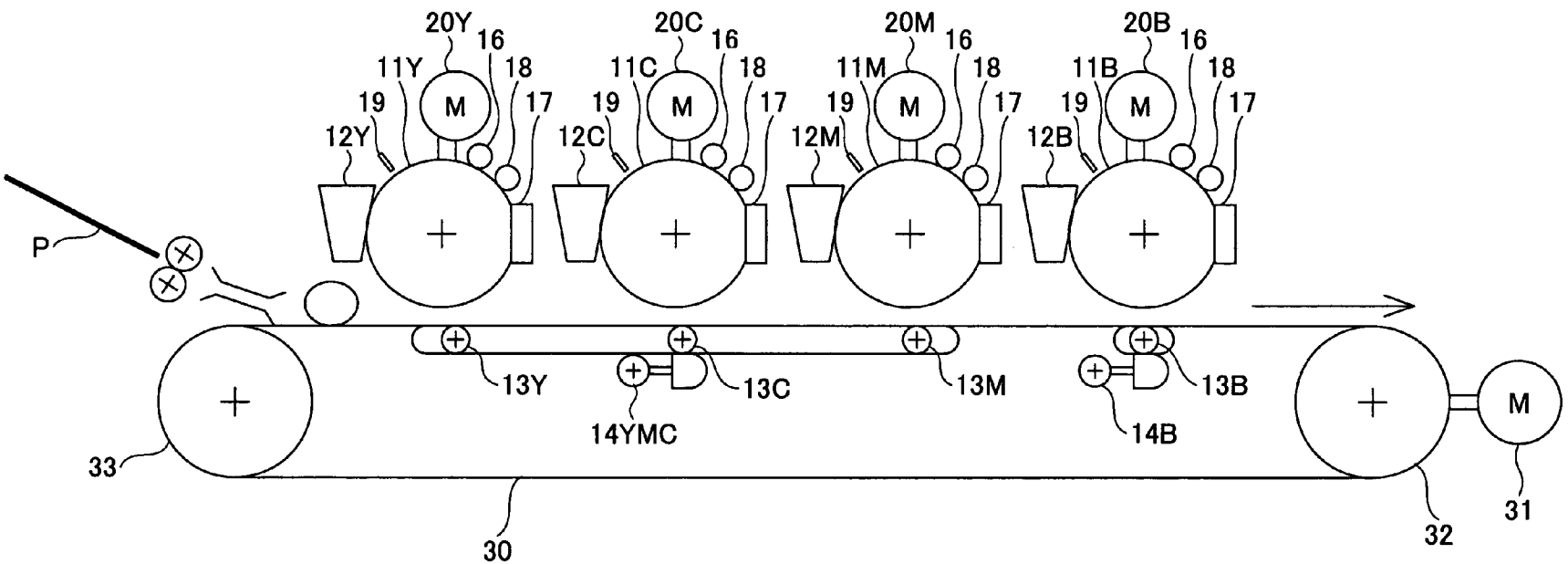
FIG.9B PRIOR ART
FIG. 9B is a diagram showing the composition of an imaging unit of an image forming device according the related art.
Figure 9C:
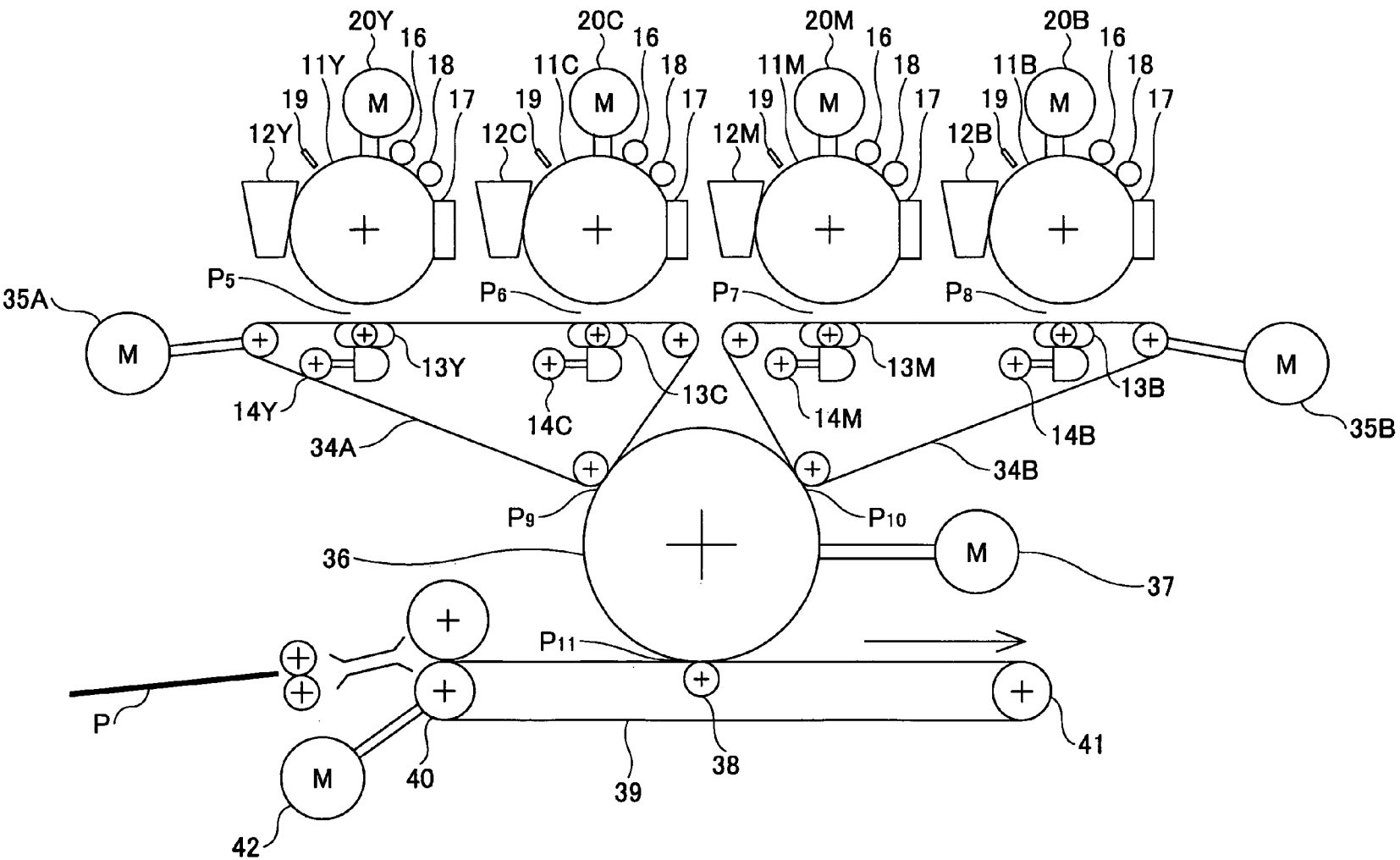
FIG.9C PRIOR ART
FIG. 9C is a diagram showing the composition of an imaging unit of an image forming device according to the related art.

Suppose that the image forming device of FIG. 1 is provided with an imaging unit of a tandem type color image forming device, and this imaging unit has the composition that is essentially the same as that of the imaging unit in any of the image forming devices according to the related art of FIG. 9A through FIG. 9C.

In FIG. 1, the elements which are essentially the same as corresponding elements in FIG. 9A through FIG. 9C are designated by the same reference numerals and a description thereof will be omitted.

The image forming device of FIG. 1 includes a main controller unit 1 which controls the entire image forming device, and a motor controller unit 2 which controls individually respective driving and rotational speeds of a plurality of motors (brushless motors etc.) 20 which rotate the plurality of photoconductors 11 of the imaging unit.

In the image forming device of FIG. 1, the main controller unit 1 includes a main CPU 4 and an image processing unit 28. The image processing unit 28 outputs an imaging reference signal FGATE, which is indicative of a start and an end of an image region of each color according to image data, to the main CPU 4 and the optical writing units 26.

The motor controller unit 2 includes a sub CPU 5 and a plurality of motor driver units 3 for controlling individually the driving and rotational speeds of the plurality of motors 20, respectively.

The motor controller unit 2 controls individually the driving and rotational speeds of the motors 20 through the motor driver unit 3 in accordance with the instructions received from the main controller unit 1.

In the image forming device of FIG. 1, the main controller unit 1 not only controls the motors through the motor controller unit 2 but also processes image data to control the image formation. Specifically, the main controller unit 1 controls the start/stop of rotation of the motors which rotate the photoconductor drums, and controls the rotational speed of each motor.

The motor controller unit 2 controls the driving of the respective motors in accordance with the instructions received from the main controller unit 1. The optical writing unit 26 deflects a laser beam according to image data, to scan the surface of the photoconductor drum, and forms an electrostatic latent image on the surface of the photoconductor drum.

The main CPU 4 of main controller unit 1 requests the optical writing unit 26 to optically write a pattern for detection of a color deviation to the transfer belt. The main CPU 4 measures an amount of color deviation of the color-deviation detection pattern based on detection results from the position sensor 27, so that a color deviation is detected.

Next, the transmitting/receiving of various signals between the main controller unit and the motor controller unit in the case of transmitting a clock signal as a speed signal will be explained with reference to FIG. 2A through FIG. 2D.

Figure 2A:
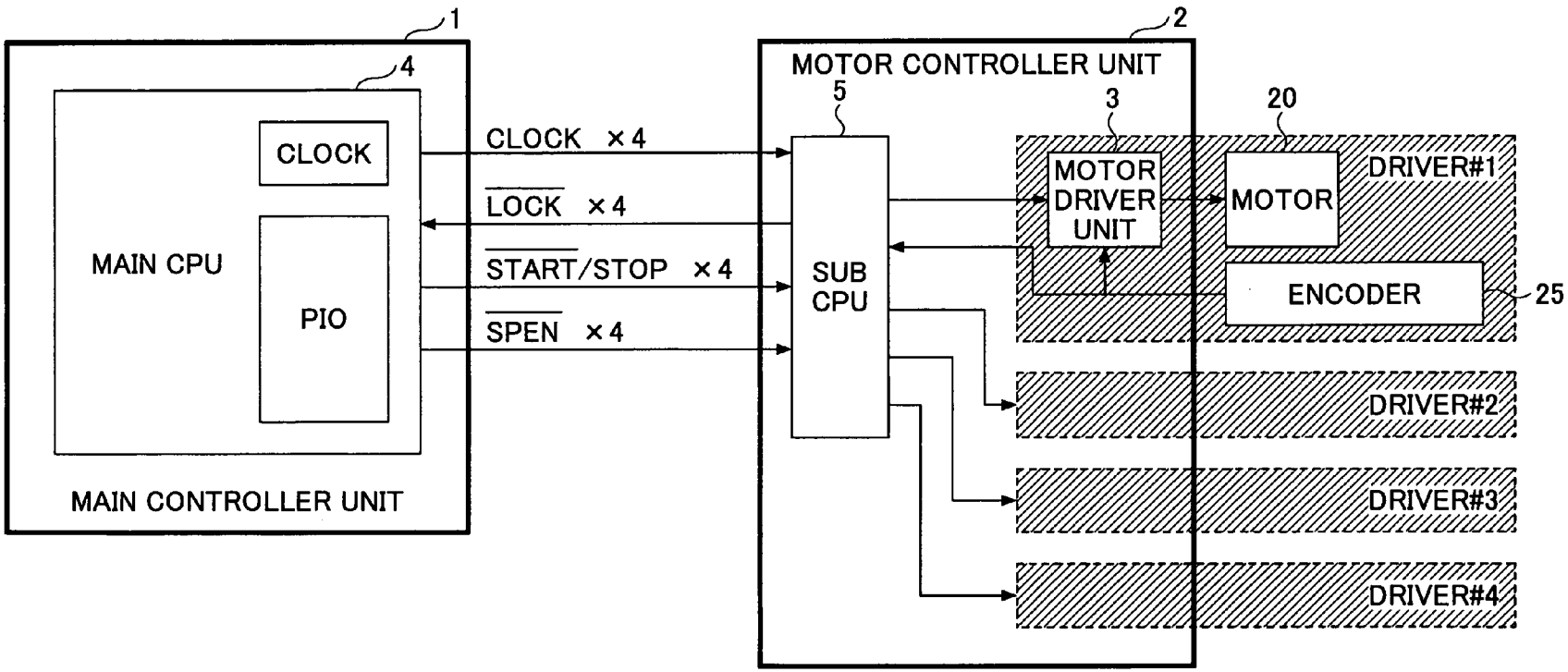
FIG. 2A is a block diagram showing various signals between the main controller unit and the motor controller unit of an image forming device in an embodiment of the invention.
Figure 2B:
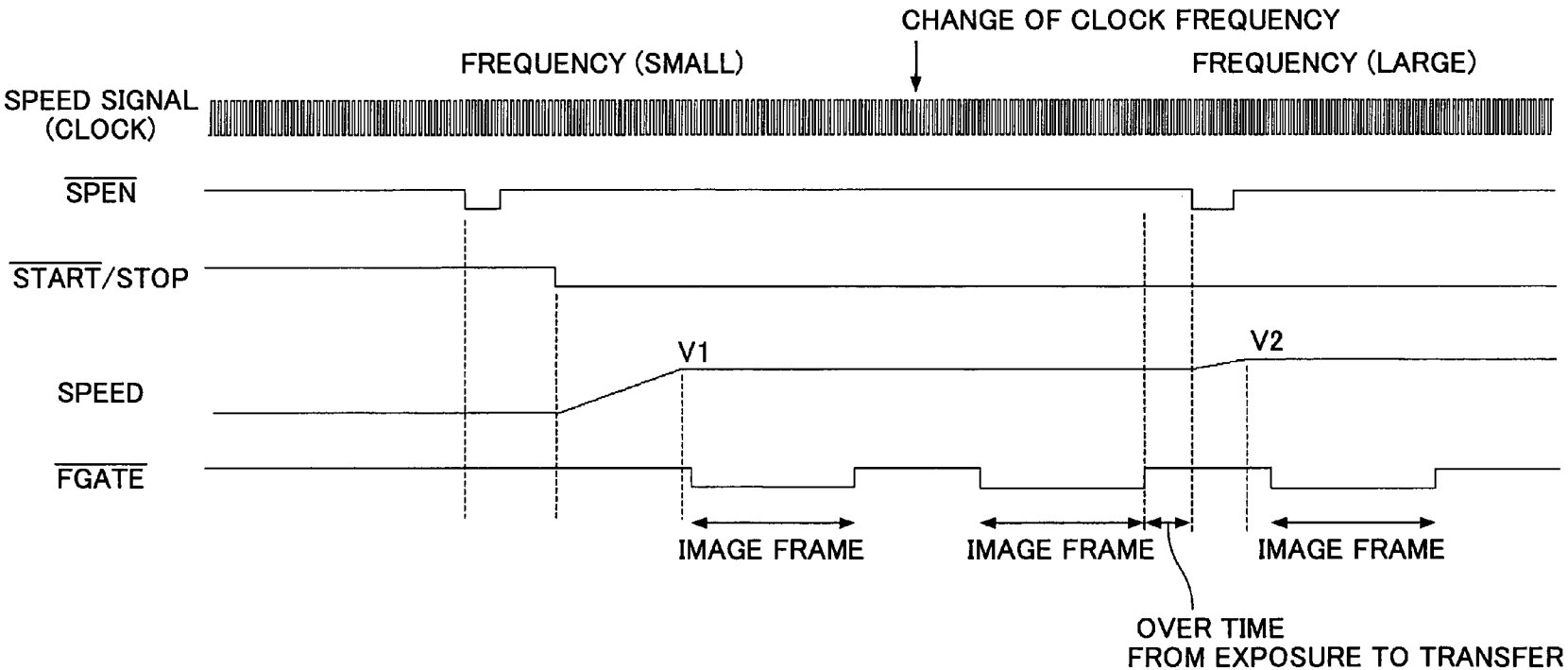
FIG. 2B is a timing chart of the signals between the main controller unit and the motor controller unit shown in FIG. 2A.
Figure 2C:
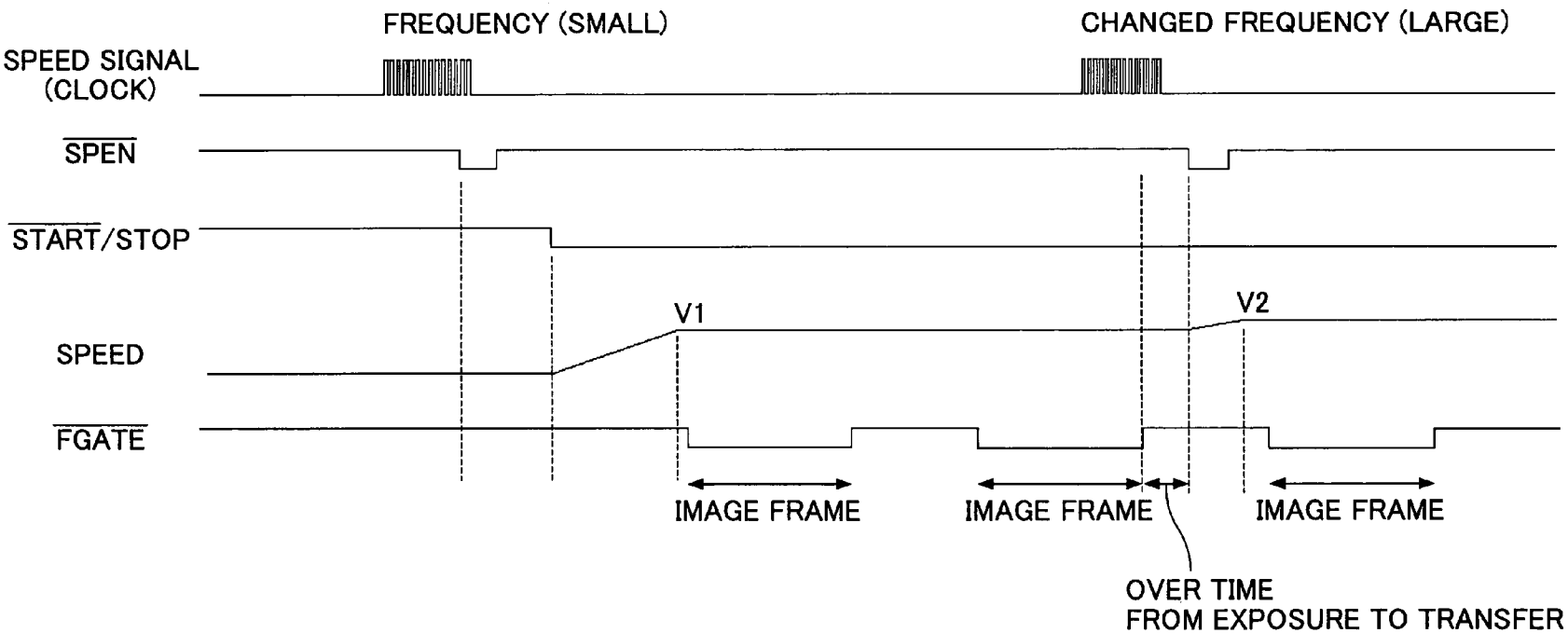
FIG. 2C is a timing chart of the signals between the main controller unit and the motor controller unit shown in FIG. 2A.
Figure 2D:
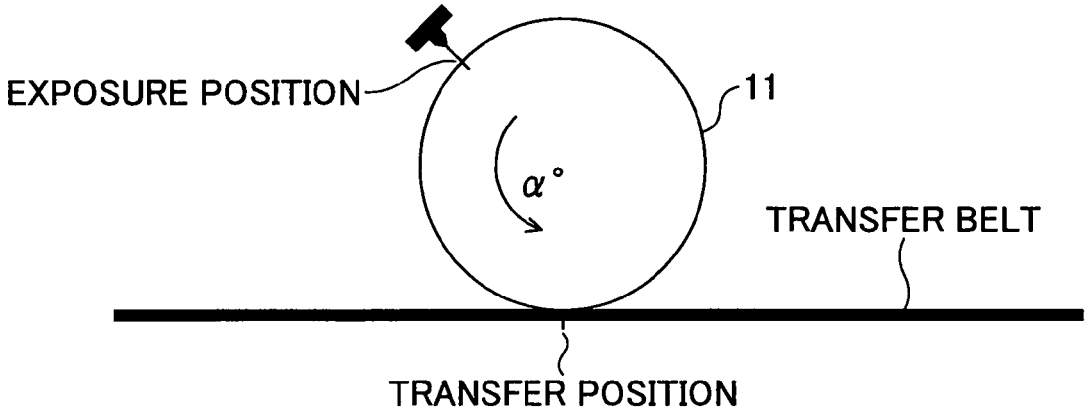
FIG. 2D is a diagram showing the angle from an exposure position to a transfer position in the photoconductor of the image forming device of FIG. 2A.

FIG. 2A is a block diagram showing various signals between the main controller unit and the motor controller unit of an image forming device in an embodiment of the invention. FIG. 2B and FIG. 2C are timing charts of the signals of the image forming device of FIG. 2A. FIG. 2D is a diagram showing the angle from an exposure position to a transfer position in the photoconductor 11 of the image forming device of FIG. 2A.

As shown in FIG. 2A, among various signals between the main CPU 4 of main controller unit 1 and the sub CPU 5 of motor controller unit 2, there are provided at least a motor start/stop request signal (START/STOP), a speed signal (CLOCK), a speed-change enabling signal (SPEN), and a stable-rotation signal (LOCK) which are connected to each motor 20.

Therefore, it is possible to set up the rotational speed of each motor individually and to drive each motor at an independently different speed. The rotational speed of each motor 20 is controlled by inputting a clock frequency corresponding to a target rotational speed to the sub CPU 5, counting the clocks, and determining a drive frequency. The rotational speed becomes large as the drive frequency is increased.

In the timing chart of FIG. 2B, asserting the START/STOP signal (in this example, a change from H level to L level) serves as a request for starting motor operation, and negating the START/STOP signal (not shown; a change from L level to H level) serves as a request for stopping motor operation.

The SPEN signal is a trigger signal which is transmitted to the sub CPU 5 by the main CPU 4 by one shot. When the SPEN signal at L level with a certain duration is received, the sub CPU 5 is allowed to change the rotational speed of the motor 20 upon detection of asserting of the SPEN signal (in this example, a change from H level to L level).

The LOCK signal is a signal which is sent to the main CPU 4 by the sub CPU 5 to notify the rotation stability of each motor 20. After the rotational speed of the motor 20 is changed, the sub CPU 5 determines whether the rotational speed of the motor 20 has reached a stable state, based on the detection signal, indicating the rotational speed of the motor, received from the encoder 25. The sub CPU 5 notifies the rotation stability of the motor 20 to the main CPU 4 by asserting the LOCK signal (not shown; a change from H level to L level). Upon receipt of the LOCK signal, the main CPU 4 starts performing image formation of a next image region.

In FIGS. 2A-2C, 3A and 3B, the negative-logic signals are indicated along with the line (overlapping line). However, in the following description, they are indicated without line (overlapping line), such as SPEN signal, etc., for the sake of convenience.

In the timing chart of FIG. 2B, the FGATE signal is an imaging reference signal which is generated by the image processing unit 28 according to image data to indicate a start and an end of an image region of each color. The image processing unit 28 outputs the FGATE signal to the main CPU 4 and each optical writing unit 26. The time width of the L level in the generated FGATE signal indicates the range of the image region of each color.

Asserting a FGATE signal (in this example, a change from the H level to the L level) serves as a start of an image region concerned, while negating a FGATE signal (in this example, a change from the L level to the H level) serves as an end of an image region concerned.

In this embodiment, the SPEN signal is not asserted when the FGATE signal is not at the H level (namely, when the FGATE signal is at the L level and any image is not being formed on the photoconductor).

However, the main CPU 4 is constituted so that, when the motors rotating the photoconductors are operating and the rotational speed of each motor is being changed during image formation, the main CPU 4 does not assert the SPEN signal until a predetermined time has elapsed immediately after the FGATE signal is negated (or until the image at the exposure position on the photoconductor arrives at the transfer position on the transfer belt).

Namely, it is necessary to perform adjustment of the rotational speed of the motor for deviation correction after an image formation operation immediately following the detection of the deviation is completed.

For this reason, the main CPU 4 asserts the SPEN signal after the predetermined time has elapsed following the time of negation of the FGATE signal.

The predetermined time is determined based on both the angle of rotation $\alpha$ (the predetermined value) around the circumference of the rotational center of the photoconductor 11 from the exposure position to the transfer position, as shown in FIG. 2D, and the rotational speed (the value determined based on the detection signal of the encoder 25) of the photoconductor 11.

The timing chart of FIG. 2B shows the case where the clock generation circuit of the main CPU 4 transmits the speed signal (CLOCK) to the sub CPU 5 invariably. When a deviation is detected, the main CPU 4 changes the clock frequency of the speed signal (CLOCK) to a clock frequency corresponding to the target rotational speed for correcting the detected deviation, and outputs the speed signal (CLOCK) in which the clock frequency is changed, to the sub CPU 5.

The timing chart of FIG. 2C shows the case where the clock generation circuit of the main CPU 4 transmits the speed signal (CLOCK) in which the clock frequency is changed, to the sub CPU 5 only when the main CPU 4 detects a deviation. In this case, the timing of transmitting of the speed signal (CLOCK) is arbitrarily selected, if the selected timing precedes the time of asserting of the SPEN signal.

Next, the transmitting/receiving of each signal between the main controller unit and the motor controller unit in the case in which the speed data by serial communication is transmitted as the speed signal will be explained with reference to FIG. 3A through FIG. 3C.

Figure 3A:
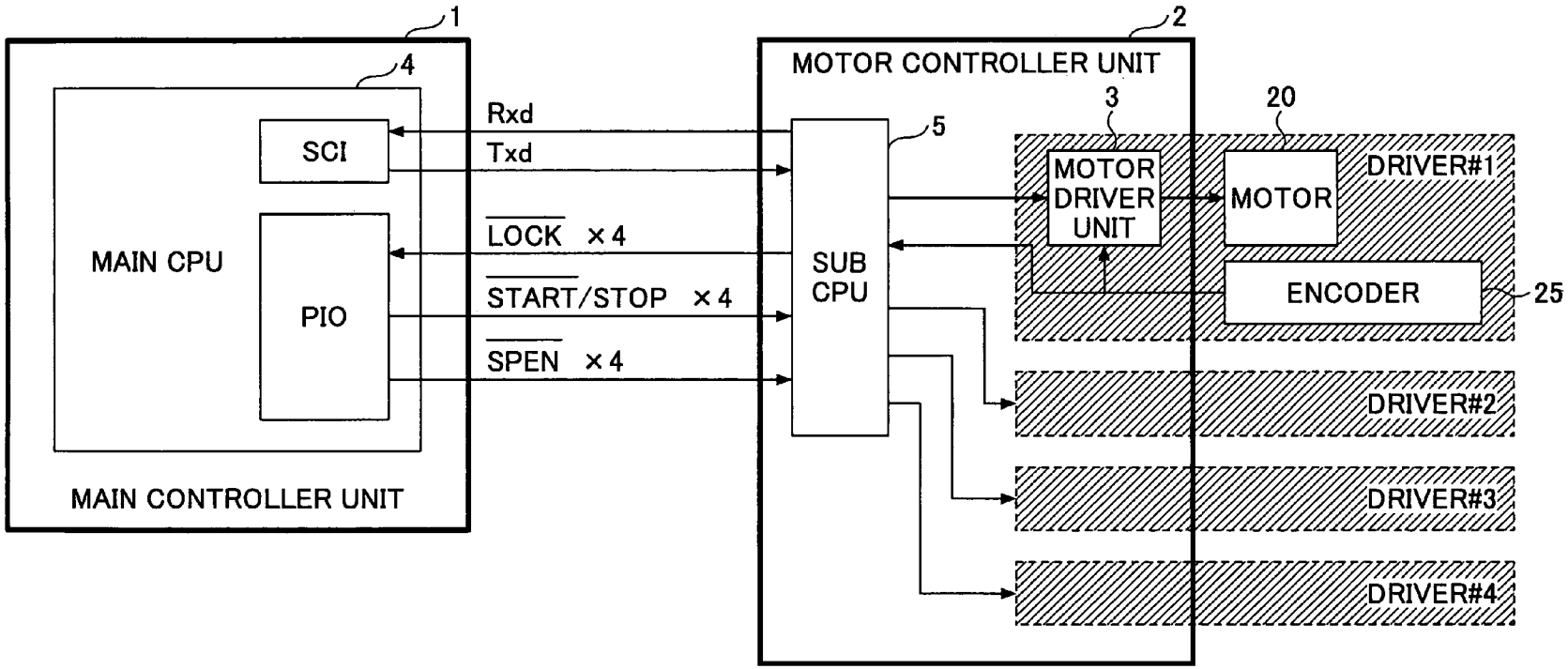
FIG. 3A is a block diagram showing various signals between a main controller unit and a motor controller unit of an image forming device in an embodiment of the invention.

FIG. 3A is a block diagram showing various signals between the main controller unit and the motor controller unit of an image forming device in an embodiment of the invention. FIG. 3B is a timing chart of the signals between the main controller unit and the motor controller unit of the image forming device of FIG. 3A. FIG. 3C is a diagram showing the angle from an exposure position to a transfer position in the photoconductor of the image forming device of FIG. 3A.

As shown in FIG. 3A, between the main CPU 4 of main controller unit 1 and the sub CPU 5 of motor controller unit 2, there are provided at least the motor start/stop request signal (START/STOP), the speed signal (Txd of serial communication), Rxd of serial communication, the speed-change enabling signal (SPEN), and the stable-rotation signal (LOCK) which are connected to each motor 20.

Therefore, it is possible to set up the rotational speed of each motor individually and to drive each motor at an independently different speed.

Figure 3B:
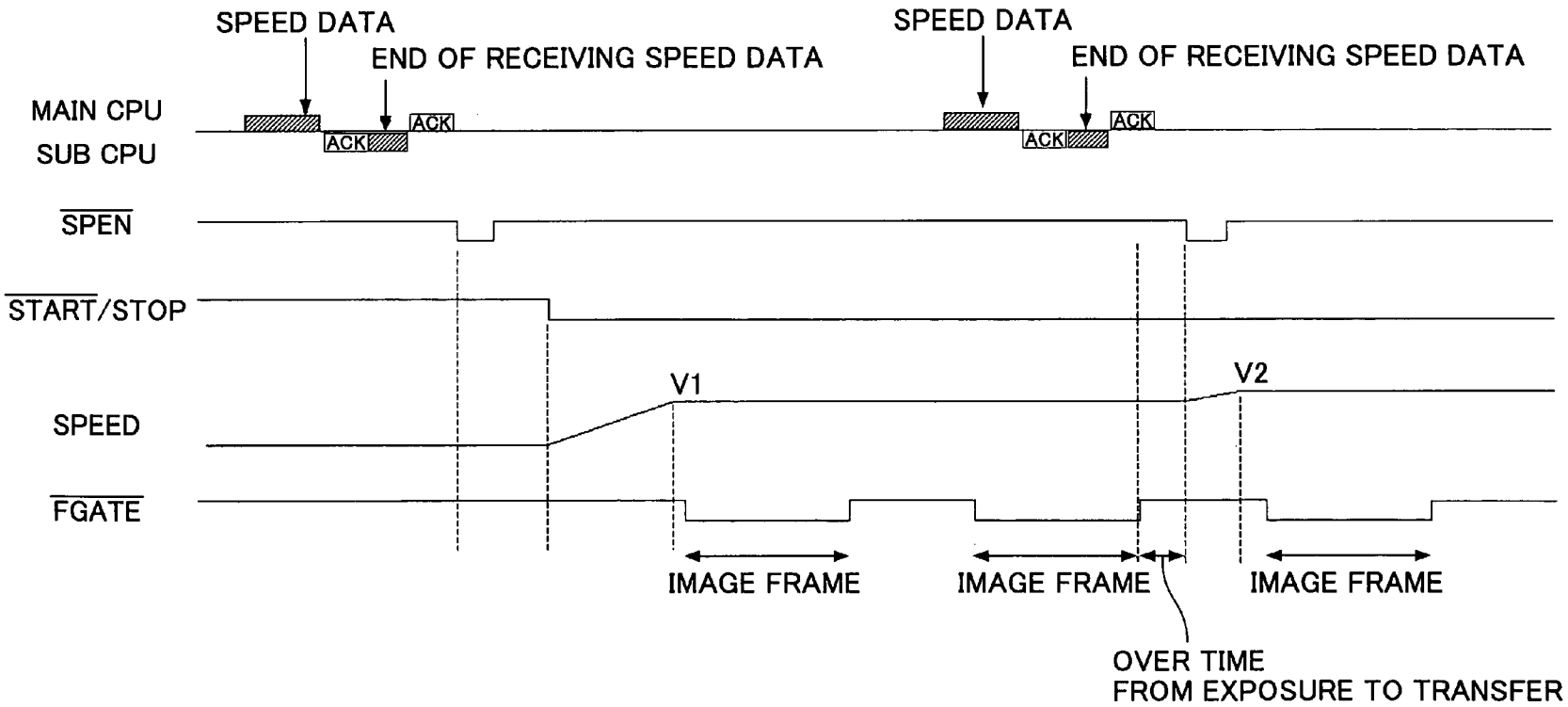
FIG. 3B is a timing chart of the signals between the main controller unit and the motor controller unit shown in FIG. 3A.

As shown in FIG. 3B, the speed data which indicates the target rotational speed is received from the main CPU 4 at the sub CPU 5 through the serial communication. The communicative protocol and the speed data are predetermined between the main CPU 4 and the sub CPU 5. The sub CPU 5 transmits, when the speed data is received, an ACK as a response message to the main CPU 4.

Subsequently, the sub CPU 5 sends a notice of end of reception of the speed data to the main CPU 4 when the received speed data is a predetermined data within the predetermined normal data.

Also in the case of FIG. 3B, asserting of the START/STOP signal (in this example, a change from the H level to the L level) serves as a motor start request signal, and negating of the START/STOP signal (not shown; a change from the L level to the H level) serves as a motor stop request signal.

The SPEN signal is a trigger signal transmitted to the sub CPU 5 by one shot. The sub CPU 5 is allowed to change the rotational speed of the motor 20 when the SPEN signal having a certain period (pulse width) at the L level is received and asserting of the SPEN signal (in this example, a change from the H level to the L level) is detected.

The LOCK signal is a signal for the sub CPU 5 to notify the rotation stability of each motor 20 to the main CPU 4. When it is determined that the rotation of motor 20, after the rotational speed of motor 20 is changed, reaches the stable state, based on the detection signal of the motor rotational speed from the encoder 25, the rotation stability of motor 20 is notified to the main CPU 4 by the sub CPU 5 by asserting the LOCK signal (not shown; a change from the H level to the L level). Upon receipt of the LOCK signal, the main CPU 4 starts the image formation for a next image region.

In the timing chart of FIG. 3B, the FGATE signal is an imaging reference signal which is generated by the image processing unit 28 according to image data to indicate a start and an end of each color of an image region.

The image processing unit 28 outputs the FGATE signal to the main CPU 4 and each optical writing unit 26. The time width of the L level in the generated FGATE signal indicates the range of the image region of each color.

Asserting of a FGATE signal (in this example, a change from the H level to the L level) serves as a start of an image region, while negating of a FGATE signal (in this example, a change from the L level to the H level) serves as an end of an image region.

In this embodiment, the SPEN signal is not asserted when the FGATE signal is not at the H level (namely, when the SPEN signal is at the L level and any image is not formed on the photoconductor).

However, the main CPU 4 is constituted so that, when the motors rotating the photoconductors are operating and the rotational speed of each motor is being changed during image formation, the main CPU 4 does not assert the SPEN signal until a predetermined time has elapsed immediately after the FGATE signal is negated (or until the image at the exposure position on the photoconductor arrives at the transfer position on the transfer belt).

Namely, it is necessary to perform adjustment of the rotational speed of the motor for deviation correction after an image formation operation immediately following the detection of the deviation is completed.

For this reason, the main CPU 4 asserts the SPEN signal after the predetermined time has elapsed following the time of negation of the FGATE signal.

Figure 3C:
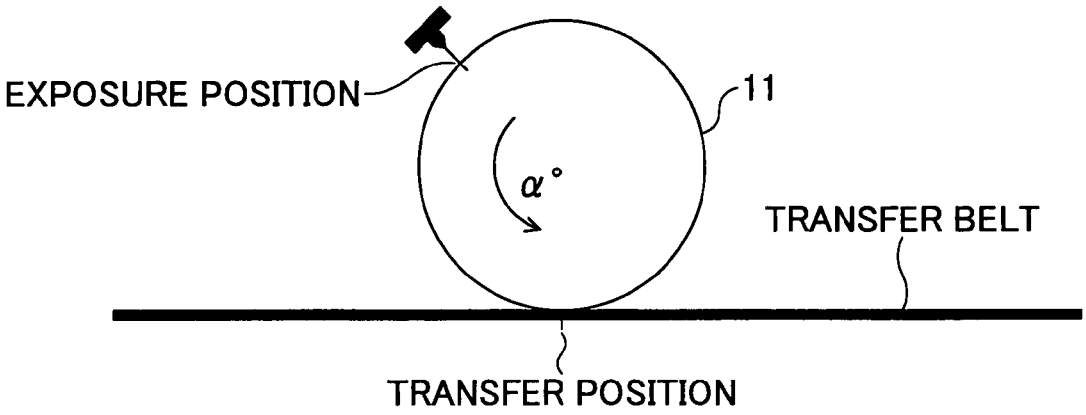
FIG. 3C is a diagram showing the angle from an exposure position to a transfer position in the photoconductor of the image forming device of FIG. 3A.

The predetermined time is determined based on both the angle of rotation $\alpha$ (the predetermined value) around the circumference of the rotation center of the photoconductor 11 from the exposure position to the transfer position, as shown in FIG. 3C, and the rotational speed (the value determined based on the detection signal of the encoder 25) of the photoconductor 11.

When it is determined that the rotation of the motor 20 after the rotational speed of the motor 20 is changed reaches the stable state based on the detection signal of the motor rotational speed from the encoder 25, the rotation stability of motor 20 is notified to the main CPU 4 by the sub CPU 5 by asserting the LOCK signal (not shown; a change from the H level to the L level). Upon receipt of the LOCK signal, the main CPU 4 starts image formation for a next image region.

Figure 4A:
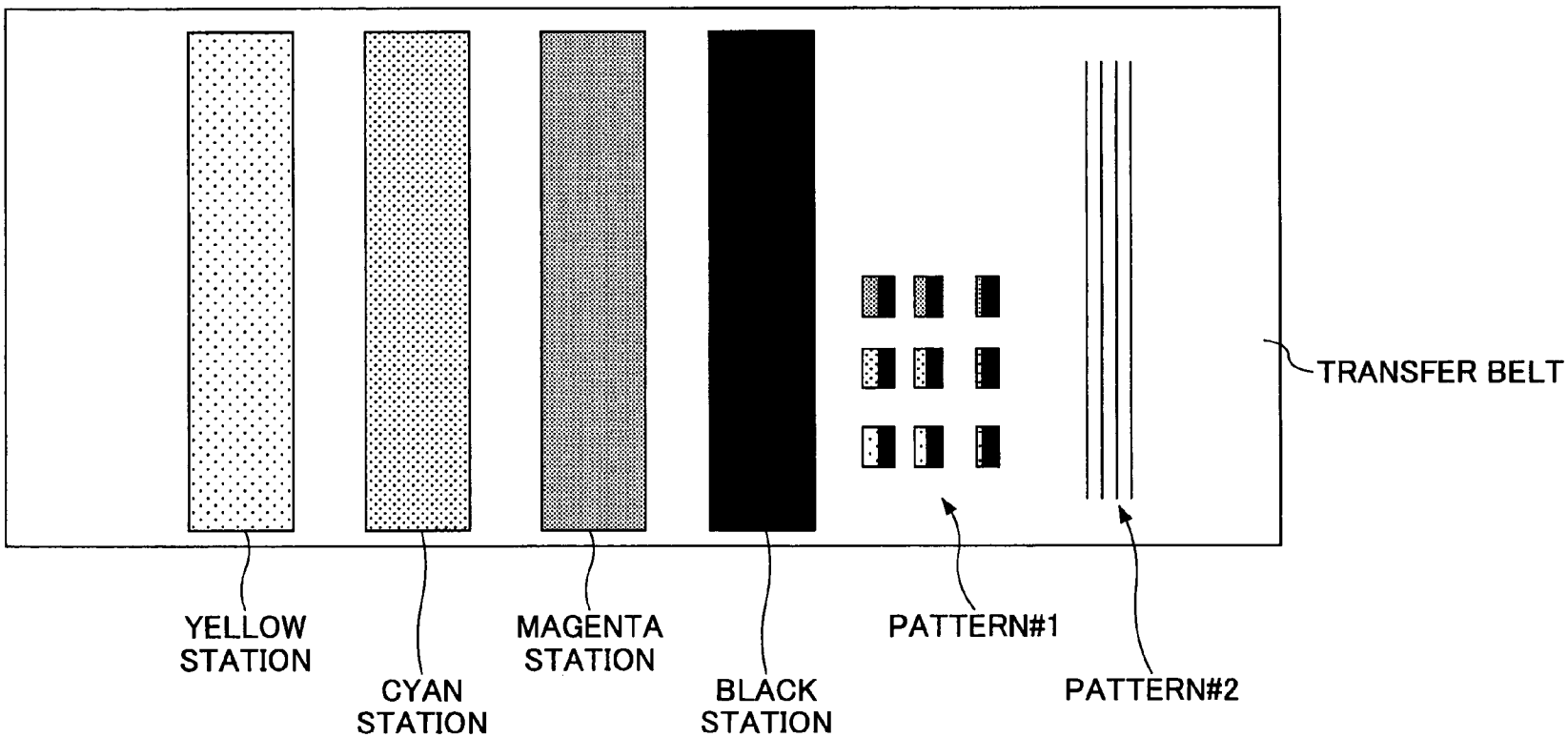
FIG. 4A is a diagram for explaining a color deviation detection method in an image forming device in an embodiment of the invention.
Figure 4B:
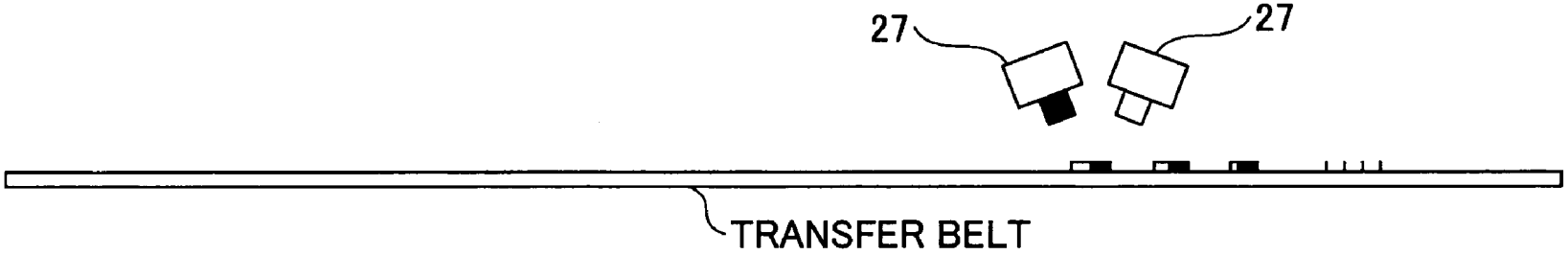
FIG. 4B is a diagram for explaining the color deviation detection method in the image forming device of FIG. 4A.

Next, a color deviation detection method which is performed by the image forming device in an embodiment of the invention will be explained with reference to FIG. 4A and FIG. 4B.

In the image forming device of this embodiment, respective stations of yellow, cyan, magenta and black (or, imaging units corresponding to each color of the image forming device of FIG. 1) include the photoconductor 11, the motor 20, and the optical writing unit 26. In each station, a pattern for detection of deviation (color deviation) is transferred to the surface of the transfer belt.

For example, in the case of the pattern #1 for detection of deviation, the black image is formed as the reference pattern, and the yellow, cyan, and magenta images are sequentially formed on the basis of the black image with different overlapping amounts, so that the pattern #1 for detection of deviation is formed.

This pattern is irradiated by a laser beam from the light source part (LED or LD) of the position sensor 27. The detecting element (photo-sensor) of the position sensor 27 detects a reflection light reflected from the pattern #1 for detection.

Based on the detection result of the position sensor 27, the main CPU 4 of the main controller unit 1 determines the amount of deviation from the desired transfer position of each of the respective colors of the pattern #1 for detection.

In the case of the pattern #2 for detection, the pattern #2 for detection of each color is formed on the transfer belt by transferring a line (pattern #2) corresponding to each color to the transfer belt so that the respective lines are parallel to the main scanning direction on the transfer belt.

Each line of the pattern #2 transferred to the transfer belt is irradiated by a laser beam from the light source part (LED and LD) of the position sensor 27. The detecting element (photo-sensor) of the position sensor 27 detects a reflection light reflected from the pattern #" for detection.

Based on the detection result of the position sensor 27, the main CPU 4 of the main controller unit 1 determines the amount of deviation from the desired transfer position of each of the respective colors of the pattern #2 for detection.

Alternatively, in the image forming device of another embodiment, a color CCD may be used for the deviation detection unit, and the method of detecting a deviation of each color based on the RGB outputs of the color CCD may be used.

The image forming device in an embodiment of the invention may be constituted so that formation of a deviation (color deviation) detection pattern is performed between image formation and image formation, and measurement of an amount of deviation (color deviation) is performed during image formation.

Next, a speed change request procedure which is performed by the main CPU 4 of the main controller unit 1 in an image forming device in an embodiment of the invention will be explained with reference to FIG. 5.

In step S1, the main CPU 4 transmits a speed signal (speed data) for indicating a target rotational speed required to correct the detected deviation, to the sub CPU 5. The step of transmitting the speed signal may be performed by any one of the transmission methods shown in FIG. 2B, FIG. 2C, and FIG. 3B.

In step S2, the main CPU 4 determines whether the FGATE signal is negated. In step S3, the main CPU 4 determines whether a predetermined time (for which the transferring of the image to the photoconductor is completed) has elapsed from the time of negating of the FGATE signal.

In step S4, the main CPU 4 asserts the SPEN signal. In step S5, the main CPU 4 determines whether a stable-rotation signal is received from the sub CPU 5.

Figure 5:
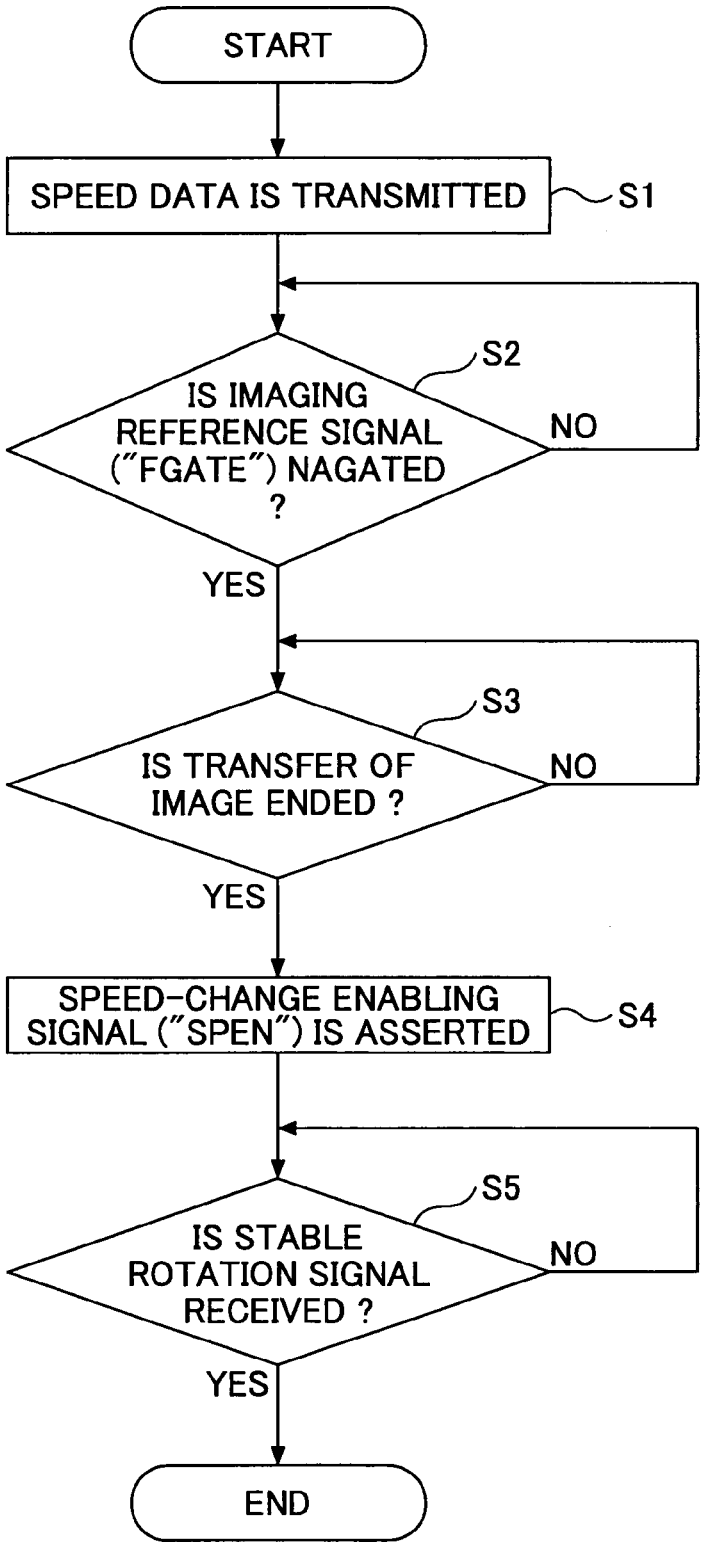
FIG. 5 is a flowchart for explaining a speed change request procedure performed by a main controller unit of an image forming device in an embodiment of the invention.

When the stable-rotation signal is received, the main CPU 4 terminates the speed change request procedure of FIG. 5 and enables the writing of the following image.

Figure 6:
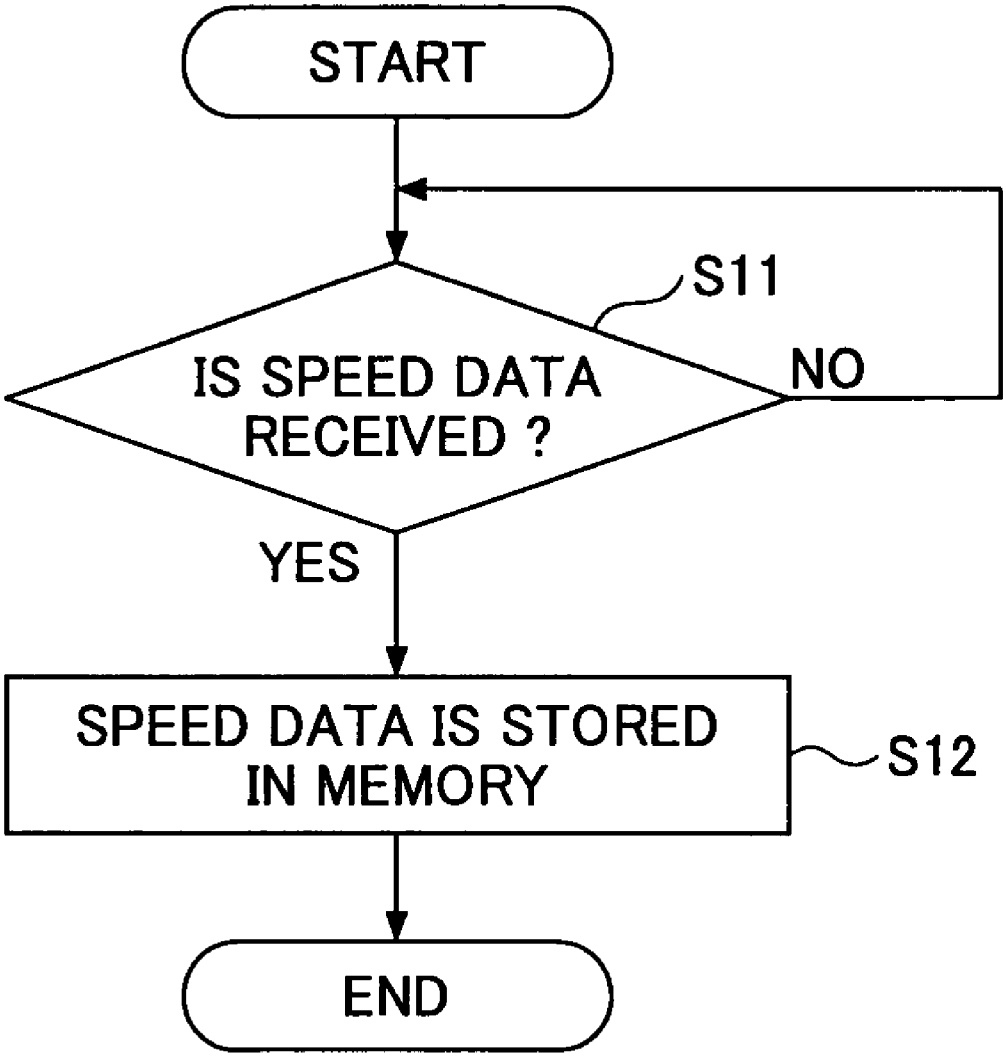
FIG. 6 is a flowchart for explaining a speed data receiving procedure performed by a motor controller unit of the image forming device of this embodiment.

Next, the speed data receiving procedure which is performed by the sub CPU 5 of motor controller unit 2 in the image forming device of this embodiment will be explained with reference to FIG. 6.

In step S11, the sub CPU 5 determines whether the speed signal (speed data) is received from the main CPU 4. When the speed data is received from the main CPU 4, the sub CPU 5 does not promptly perform incorporation of the received speed data as the rotational speed change. In step S12, the sub CPU 5 stores the received speed data into a RAM (not shown) of the sub CPU 5 as reserved data of rotational speed change. The actual change of the rotational speed of the motor is deferred until the SPEN signal is asserted.

Figure 7:
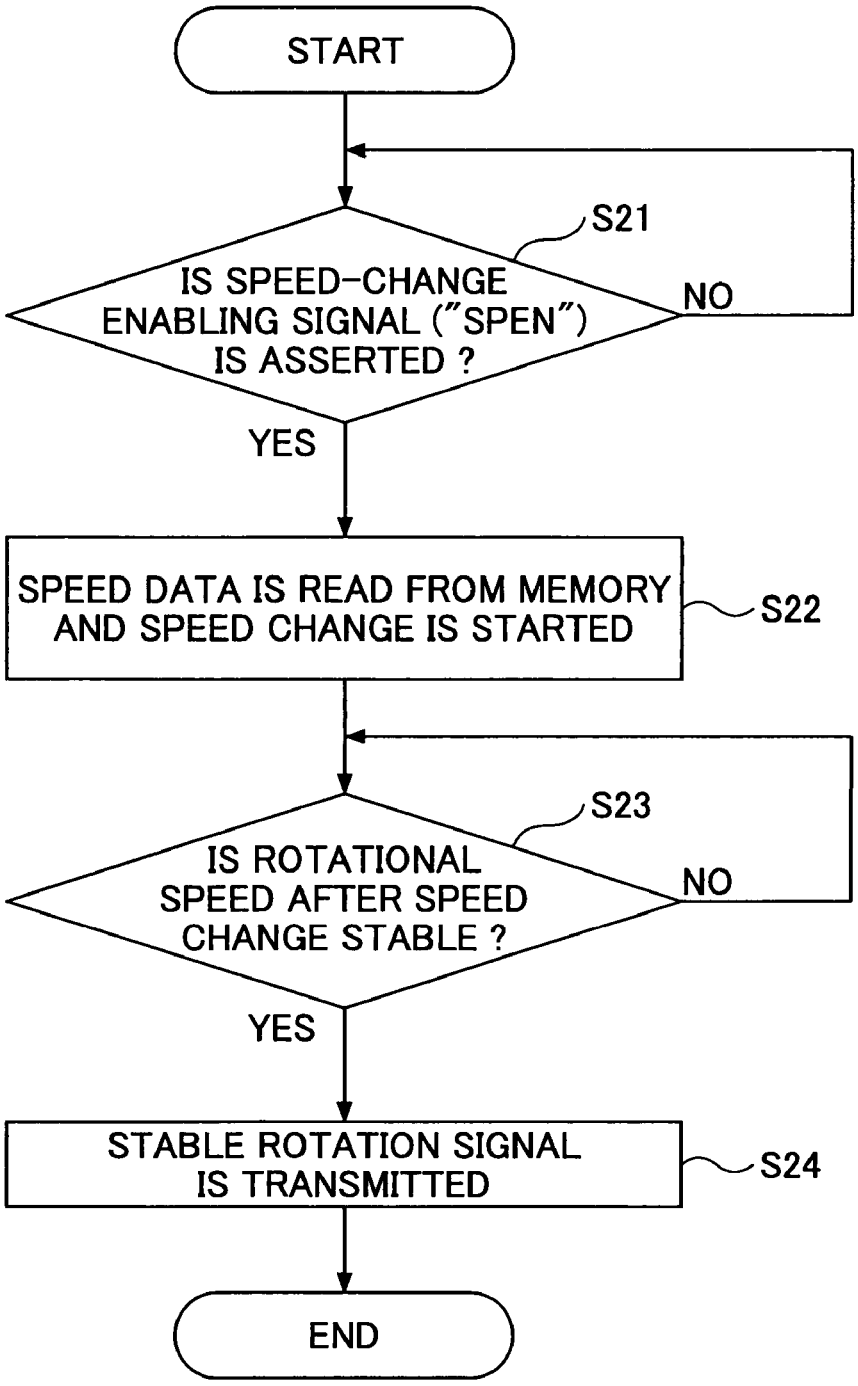
FIG. 7 is a flowchart for explaining a speed change execution procedure performed by the motor controller unit of the image forming device of this embodiment.

Next, the speed change execution procedure which is performed by the sub CPU 5 of the motor controller unit 2 in the image forming device of this embodiment will be explained with reference to FIG. 7.

In step S21, the sub CPU 5 determines whether the SPEN signal is asserted. When the asserting of the SPEN signal is detected, in step S22, the sub CPU 5 reads out the speed data (stored in the step S12 of FIG. 6) from the RAM and starts changing of the rotational speed of the corresponding motor 20 to the target rotational speed.

In step S23, the sub CPU 5 determines whether the rotational speed of the corresponding motor 20 is stabilized while monitoring the detection signal from the encoder 25.

After it is determined that the rotational speed of the corresponding motor 20 after the speed change is stabilized, in step S24, the sub CPU 5 notifies the main CPU 4 of the stability of the rotation speed of the motor by transmitting a LOCK signal to the main CPU 4.

Next, the transfer position deviation by the image forming device in an embodiment of the invention will be explained with reference to FIG. 8A and FIG. 8B.

Figure 8A:
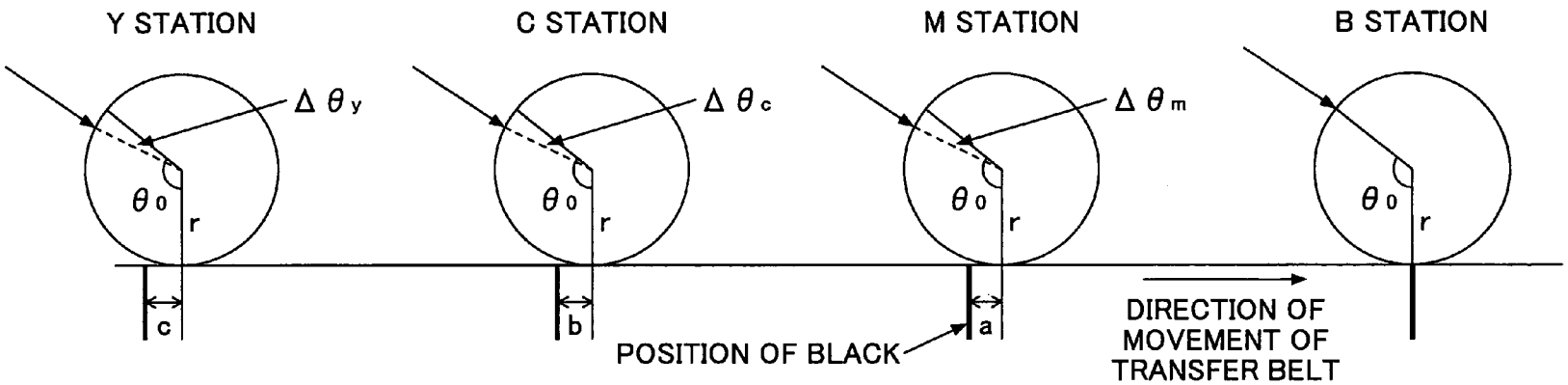
FIG. 8A is a diagram for explaining a transfer position deviation in the image forming device of the invention.

FIG. 8A is a diagram showing the deviations (a, b, c) at the transfer positions of magenta, cyan and yellow on the basis of the black position in which the station of black (or the imaging unit of black in the image forming device of FIG. 1 including the photoconductor 11, the motor 20 and the optical writing unit 26) is arranged in the most downstream location.

The image transfer to the transfer belt is performed in order of yellow, cyan, magenta, and black, respectively. There is shown the case in which, on the basis of the rotational speed of the photoconductor 11 of black, the rotational speeds of the photoconductors 11 are changed from the deviations of the respective colors so that the transfer positions are adjusted. Suppose that the main controller unit 1 requests the motor controller unit 2 to change the motor speed by transmitting the speed signal having the clock frequency indicating the target rotational speed.

FIG. 8A shows the case where the transfer position of magenta is shifted in the belt transport direction from the transfer position of black.

In this case, the time "to" from the exposure position of black to the transfer position is represented by the formula:

$$to=\theta o/\omega o$$

where θo denotes a rotational angle of the photoconductor, and ωo denotes an angular velocity of the photoconductor.

The amount "a" of deviation is represented by the formula:

$$a=r\times\Delta\theta m$$

where r denotes a radius of the photoconductor and Δθm denotes a deviation of the rotation angle of the photoconductor.

The time "tm" from the exposure position of magenta to the transfer position is represented by the formula:

$$tm=(\theta o-\Delta\theta m)/\omega o.$$

If ωo is changed to ωm to meet the condition to=tm, the corresponding formulas are as follows:

$$to=\theta o/\omega o,$$

$$tm=(\theta o-\Delta\theta m)/\omega m;$$

$$\theta o/\omega o=(\theta o-\Delta\theta m)/\omega m,$$

$$\begin{aligned}\omega m &= (\theta o-\Delta\theta m)\times\omega o/\theta o\\ &= (1-\Delta\theta m/\theta o)\times\omega o\\ &= (1-a/r\theta o)\times\omega o.\end{aligned}$$

The clock frequency fm of the target speed signal of the motor 20 of the photoconductor drum 11 of magenta is represented by the formula:

$$fm=(1-a/r\theta o)\times fo$$

where fo denotes a clock frequency (a fixed value) of the reference speed signal of the motor 20 of the photoconductor drum 11 of black.

Similarly, the clock frequencies "fc" and "fy" of the target speed signals of the motors 20 of the photoconductor drums 11 of cyan and yellow are represented by the formulas:

$$fc=(1-b/r\,\theta o)\times fo$$

$$fy=(1-c/r\,\theta o)\times fo.$$

Next, the deviation correcting method in the case where the transfer position of magenta is shifted from the transfer position of black in the direction opposite to the belt transport direction will be explained.

Figure 8B:
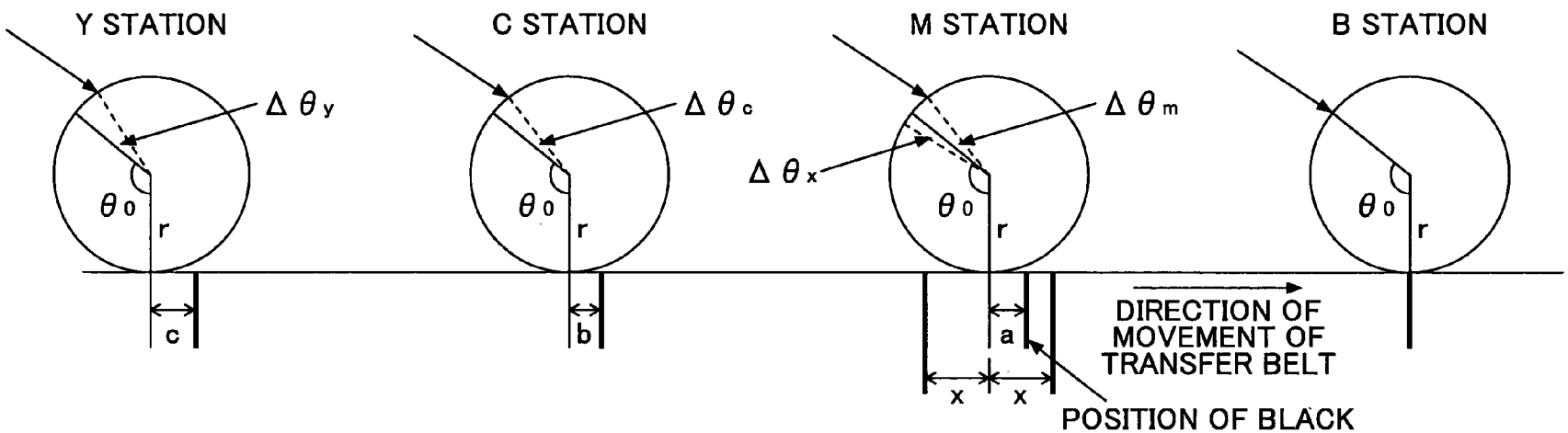
FIG. 8B is a diagram for explaining a transfer position deviation in the image forming device of the invention.

FIG. 8B shows the case where the transfer position of magenta is shifted from the transfer position of black in the direction opposite to the belt transport direction.

In this case, the transfer position of magenta is certainly shifted from the transfer position of black to a quick-timing position by making the exposure registration position in the sub-scanning direction (exposure timing) of the exposure device (LD or LED) to the photoconductor.

If the exposure position in the sub-scanning direction is adjusted in tx second pitch, the time from the reference exposure of black to the transfer position is represented by the formula:

$$to=\theta o/\omega o.$$

The amount of deviation is represented by the formula:

$$a=r\times\Delta\theta m.$$

The adjustment angle Δθx when the exposure timing is changed by tx seconds from the reference time at the time of the rotational speed of ωo is represented by the formula:

$$\Delta\theta x=x/r$$

where x denotes the amount of movement of the transfer position when the exposure timing at the time of the reference rotational speed is changed by tx seconds.

The amount of adjustment deviation at that time is represented by the formula:

$$x-a=r\omega o\times tx-a=rx(\Delta\theta x-\Delta\theta m).$$

The time from the exposure position of magenta to the transfer position is represented by the formula:

$$tm=(\theta o+\Delta\theta m-\Delta\theta x)/\omega o.$$

By changing ωo to ωm to meet the condition to=tm, the following formulas are given:

$$to=\theta o/\omega o,$$

$$tm=(\theta o+\Delta\theta m-\Delta\theta x)/\omega m$$

$$\theta o/\omega o=(\theta o+\Delta\theta m-\Delta\theta x)/\omega m,$$

$$\omega m=\{(1-(x-a)/r\theta o)\}\times\theta o,$$

$$fm=\{(1-(x-a)/r\theta o)\}\times fo.$$

Similarly, the clock frequencies for cyan and yellow are represented as follows:

$$fc=\{(1-(x-b)/r\theta o)\}\times fo,$$

$$fy=\{(1-(x-c)/r\theta o)\}\times fo.$$

Therefore, it is possible to adjust the transfer timing of each of the yellow, magenta and cyan stations with respect to the black station as the reference by changing the clock frequency (motor rotational speed) to a clock frequency of the target speed signal.

Thereby, the rotation speed of the motor 20 of the photoconductor drum 11 of black can be made relatively quicker from that of other color stations, so that a color deviation can be suppressed.

For example, in the case where r=0.03 m, θo=2.827433 rads, fo=1000 Hz, x=30 micrometers, and the amount of deviation with reference to that of black being 10 micrometers earlier in the belt transport direction, the clock frequency of the target speed signal of the motor for correcting the rotational speed of the station may be set to 999.882 Hz.

On the other hand, in the case where the amount of deviation with reference to that of black is 10 micrometers later in the belt transport direction, the clock frequency of the target speed signal of the motor for correcting the rotational speed of the station may be set to 1000.118 Hz.

In the above-mentioned embodiment, the image forming device is constituted so that the main controller unit includes: a speed signal transmitting unit which transmits a speed signal, indicating a target rotational speed for correcting the deviation detected by the deviation detection unit, to the motor controller unit; and an enabling-signal transmitting unit which transmits, to the motor controller unit, a speed-change enabling signal that enables the motor controller unit to start a speed change of a rotational speed of one of the motors, after passing of a predetermined time from a time an imaging reference signal, which is indicative of a start and an end of an image region of each color, indicates an end of a corresponding image region immediately after transmission of the speed signal. Accordingly, it is possible to correct a deviation (color deviation) while continuously operating the motors to rotate the photoconductors, so that the time needed for deviation correction is shortened and the efficiency of image formation is raised.

The present invention is not limited to the above-described embodiments and variations and modifications may be made without departing from the scope of the present invention.

The present application is based on and claims the benefit of priority of Japanese patent application No. 2006-241769, filed on Sep. 6, 2006, and Japanese patent application No. 2007-183402, filed on Jul. 12, 2007, the entire contents of which are hereby incorporated by reference.

What is claimed is:

1. An image forming device in which a plurality of image carriers are installed in a tandem manner, images of different colors are formed on the image carriers and combined to form a color image, the image forming device including a main controller unit controlling the image forming device, a motor controller unit controlling individually rotational speeds of a plurality of motors rotating the image carriers respectively, and a deviation detection unit detecting a deviation of the color image, the main controller unit comprising:

a speed signal transmitting unit transmitting a speed signal, indicating a target rotational speed for correcting the deviation detected by the deviation detection unit, to the motor controller unit; and an enabling-signal transmitting unit transmitting, to the motor controller unit, a speed-change enabling signal that enables the motor controller unit to start a speed change of a rotational speed of one of the motors, after passing of a predetermined time from a time an imaging reference signal, which is indicative of a start and an end of an image region of each color, indicates an end of a corresponding image region immediately after transmission of the speed signal, wherein said predetermined time is calculated from a rotation angle between an exposure position and a transfer position of the image carrier relative to a center of rotation of the image carrier, and a rotation speed of the image carrier.

2. The image forming device according to claim 1, wherein the motor controller unit is provided to include a speed data storing unit which stores speed data indicated by the speed signal into a memory, in response to the speed signal received from the main controller unit.

3. The image forming device according to claim 2, wherein the motor controller unit is provided to include a rotational speed change unit which reads the speed data from the memory in response to the speed-change enabling signal received from the main controller unit, and changes a rotational speed of the motor concerned to the target rotational speed.

4. The image forming device according to claim 3, wherein the motor controller unit is provided to include a stable-rotation-signal transmitting unit which transmits a stable-rotation signal to the main controller unit after the rotational speed of the motor concerned changed by the rotational speed change unit is stabilized.

5. The image forming device according to claim 1, wherein the deviation detection unit is provided to determine an amount of deviation from a target position based on detection results from a sensor which detects optically a pattern for deviation detection transferred to a transferring medium through the image carriers.

6. The image forming device according to claim 1, wherein the speed signal is a clock signal having a clock frequency indicating the target rotational speed.

7. The image forming device according to claim 1, wherein the speed signal is a clock signal having a clock frequency indicating the target rotational speed, and the speed signal transmitting unit is provided to transmit the clock signal to the motor controller unit when a deviation is detected by the deviation detection unit.

8. The image forming device according to claim 1, wherein the speed signal is a speed data which is transmitted to the motor controller unit through serial communication.

9. A deviation correcting method for use in an image forming device in which a plurality of image carriers are installed in a tandem manner, images of different colors are formed on the image carriers and combined to form a color image, the image forming device including a main controller unit controlling the image forming device, and a motor controller unit controlling individually rotational speeds of a plurality of motors rotating the image carriers respectively, the deviation correcting method comprising:

detecting a deviation of the color image;

transmitting a speed signal, indicating a target rotational speed for correcting the deviation detected in the detecting step, from the main controller unit to the motor controller unit; and transmitting a speed-change enabling signal that enables the motor controller unit to start a speed change of a rotational speed of one of the motors, from the main controller unit to the motor controller unit after passing of a predetermined time from a time an imaging reference signal, which is indicative of a start and an end of an image region of each color, indicates an end of a corresponding image region immediately after transmission of the speed signal, wherein said predetermined time is calculated from a rotation angle between an exposure position and a transfer position of the image carrier relative to a center of rotation of the image carrier, and a rotation speed of the image carrier.

10. The deviation correcting method according to claim 9, further comprising a step of storing speed data indicated by the speed signal into a memory of the motor controller unit when the speed signal is received from the main controller unit.

11. The deviation correcting method according to claim 10, further comprising steps of: reading the speed data from the memory by the motor controller unit in response to the speed-change-enabling signal received from the main controller unit; and changing a rotational speed of the motor concerned to the target rotational speed.

12. The deviation correcting method according to claim 11, further comprising a step of transmitting a stable-rotation signal from the motor controller unit to the main controller unit after the rotational speed of the motor concerned changed in the step of changing the rotational speed is stabilized.

13. The deviation correcting method according to claim 9, further comprising a step of determining an amount of deviation from a target position by the main controller unit based on detection results from a sensor which detects optically a pattern for deviation detection transferred to a transferring medium through the image carriers.

14. The deviation correcting method according to claim 9, wherein the speed signal is a clock signal having a clock frequency indicating a target rotational speed.

15. The deviation correcting method according to claim 9, wherein the speed signal is a clock signal having a clock frequency indicating a target rotational speed, and wherein the clock signal is transmitted from the main controller unit to the motor controller unit in the step of transmitting the speed signal when a deviation is detected in the step of detecting the deviation.

16. The deviation correcting method according to claim 9, wherein the speed signal is a speed data which is transmitted to the motor controller unit through serial communication.

* * * * *